US005299636A

United States Patent [19]

Potier

[11] Patent Number: 5,299,636

[45] Date of Patent: Apr. 5, 1994

[54] HEAT EXCHANGER HAVING MORE THAN ONE SET OF TUBES, IN PARTICULAR FOR A MOTOR VEHICLE

[75] Inventor: Michel Potier, Rambouillet, France

[73] Assignee: Valeo Thermique Moteur, Le Mesnil-Saint-Denis, France

[21] Appl. No.: 88,212

[22] Filed: Jul. 6, 1993

[30] Foreign Application Priority Data

Jul. 8, 1992 [FR] France ..... 92 08481

[51] Int. Cl.[5] ..... F28F 9/04

[52] U.S. Cl. ..... 165/173; 165/175

[58] Field of Search ..... 165/151, 153, 173, 175

[56] References Cited

U.S. PATENT DOCUMENTS 4,369,837 1/1983 Moranne ..... 165/175
5,174,372 12/1992 Potier et al. ..... 165/173
5,219,024 6/1993 Potier ..... 165/173

FOREIGN PATENT DOCUMENTS 0429401 5/1991 European Pat. Off. .
053001020 5/1991 European Pat. Off. .
8708104 9/1987 Fed. Rep. of Germany .

*Primary Examiner*—John Rivell
*Assistant Examiner*—L. R. Leo
*Attorney, Agent, or Firm*—Morgan & Finnegan

[57] ABSTRACT

A heat exchanger, particularly a radiator for a motor vehicle, has a header plate which is formed with holes, each of which receives the respective end portions of a plurality of adjacent tubes, with a compressible sealing gasket being interposed between the header plate and the tube end portions. The sealing gasket has collar portions, each of which is fitted in one hole of the header plate and includes annular portions which surround the respective end portions of the tubes received in the hole. The annular portions are joined together in an intersection region having thickened zones which are adapted to be compressed between the edge of the hole in the header plate and the tube end portions received in that hole.

8 Claims, 1 Drawing Sheet

HEAT EXCHANGER HAVING MORE THAN ONE SET OF TUBES, IN PARTICULAR FOR A MOTOR VEHICLE

FIELD OF THE INVENTION

This invention relates to a heat exchanger of the type comprising a bundle of parallel tubes which are arranged in sets, with the tubes having respective end portions which are received in holes formed in a header plate of the heat exchanger.

BACKGROUND OF THE INVENTION

Such heat exchangers are used especially in motor vehicles having internal combustion engines, so as to act either as a cooling radiator for the engine, or as a heating radiator for the cabin of the vehicle. In either of these two applications, the tubes in the tube bundle constituting the plurality of sets of tubes carry a fluid, which is generally a mixture of water and anti-freeze, which passes through the tubes that form part of the engine cooling circuit, while a stream of air is directed over the tubes in the bundle. It is common practice to provide, in known heat exchangers of this type, the same number of holes in the header plate as there are tubes in the bundle, so that each tube end portion will be received individually in a respective individual hole in the header plate, to which it is sealingly secured.

In the specification of French patent application No. 91 03411 of the present Applicants, there is disclosed a heat exchanger of the type comprising: a bundle of parallel tubes arranged in sets: a header plate which is formed with holes, in which each said hole receives the respective end portions of a plurality of adjacent tubes of different sets of tubes in the bundle; and a compressible sealing gasket, which is formed with collar portions, each of which is fitted in a said hole in the header plate and comprises annular portions which surround the respective tube end portions received in the hole in the header plate.

Due to the fact that the respective end portions of a plurality of tubes are received in a single hole in the header plate, instead of each end portion being received individually in one hole in the latter, the pitch defined between the axes of the tubes, as between one set of tubes and the other, is able to be set at a minimum value. In this way, the performance of the heat exchanger can be optimised, with minimal width of the header plate.

However, in the last mentioned type of heat exchanger of the prior art, the shape of the holes is such that, after assembly, the sealing gasket cannot be compressed uniformly over the whole periphery of the tubes which are introduced into any one of the holes in the header plate. This compression is in fact weaker in that region of the gasket which lies between two adjacent tube end portions, since this region of the gasket is thinner than elsewhere on the gasket. The result is that poor sealing can occur, which is prejudicial to proper operation of the heat exchanger.

DISCUSSION OF THE INVENTION

In consequence, one object of the invention is to overcome this last mentioned disadvantage.

A further object of the invention is to provide a heat exchanger of this type which enables uniform compression of the gasket to be obtained over the whole periphery of the tubes, and especially in that region of the gasket which lies between the adjacent tube end portions.

To this end, according to the invention a heat exchanger of the type comprising: a bundle of parallel tubes arranged in sets; a header plate which is formed with holes, in which each said hole receives the respective end portions of a plurality of adjacent tubes of different sets of tubes in the bundle; and a compressible sealing gasket having collar portions, each of which is placed in a said hole, with each said collar portion including annular portions which surround the respective end portions of the tubes received in the hole, is characterised in that the annular portions of each collar portion of the gasket are joined together in pairs in an intersection region which includes thickened zones which are adapted to be compressed between the edge of the hole and the tube end portions received in the latter. These integral thickened portions provide compensation for the lack of compression in the intersection regions of the collar portions of the gasket, each of which lies between two adjacent tube end portions. Substantially perfect sealing is guaranteed with this arrangement, at the junction between the tubes of the tube bundle and the header plate.

The intersection region of the collar portion of each gasket may have said thickened portions disposed within the collar portion and adapted to be compressed by the tube end portions received in the annular portions of the collar portion.

Preferably, the intersection region of each collar portion has a pair of thickened zones disposed inside each of the annular portions of the collar portion.

In the case in which each collar portion is arranged to fit snugly on the tube end portions associated therewith and having a cross section of generally oval or elliptical shape defining a major axis, the said thickened zones of each pair are disposed symmetrically on either side of the said major axis.

Preferably, the intersection region of each collar portion of the gasket has thickened zones disposed on the outside of the collar portion and adapted to be compressed by the edge of the associated hole in the header plate. In that case, each intersection region preferably includes two opposed thickened zones which are adapted to be compressed between two opposed regions of the associated hole, which define a neck.

In each gasket, the thickened portions may be arranged both inside and outside the collar portion.

The description of a preferred embodiment of the invention which follows is given by way of example only, and with reference to the accompanying drawings.

DESCRIPTION OF A PREFERRED EMBODIMENT OF THE INVENTION

Figure 1:
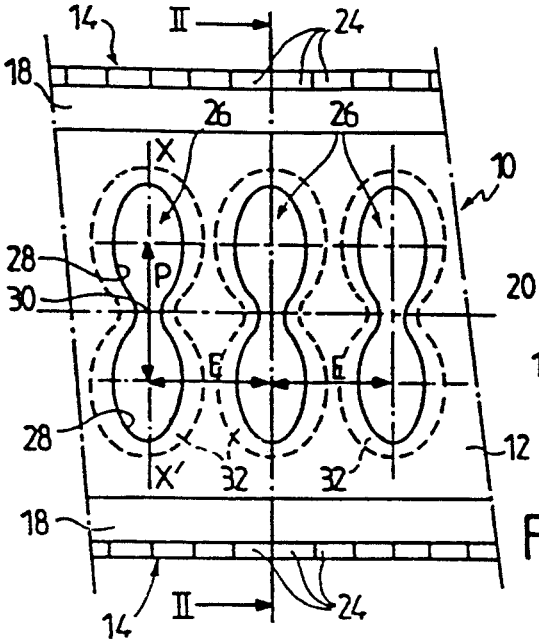
FIG. 1 is a top plan view of part of a header plate which is part of a heat exchanger in accordance with the invention.
Figure 2:
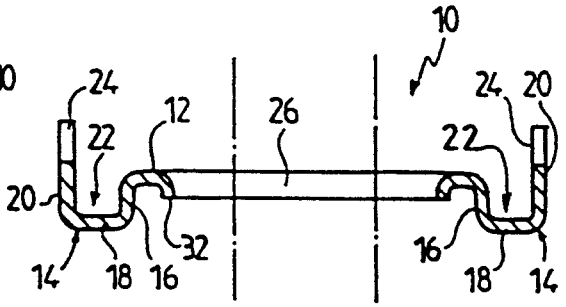
FIG. 2 is a view in cross section taken on the line II—II in FIG. 1.

Reference is first made to FIGS. 1 and 2, which show a header plate 10, also referred to as a perforated plate, having a spine portion 12 of generally rectangular shape. The spine portion 12 is preferably made of a metallic material, and is bounded by two parallel rims 14 corresponding to the two large sides of the rectangle, together with two other parallel rims (not shown in the drawings), which correspond to the short sides of the rectangle.

As is best seen in FIG. 2, each of the rims 14 comprises a portion 16 which is joined at a right angle to the spine portion 12, a portion 18 which is joined at a right angle to the first portion 16, and finally a portion 20 which is joined at a right angle to the second portion 18. The portions 16 and 18 of each rim 14 thus define a groove 22 which extends over the whole periphery of the header plate 10. The function of this groove 22 will be explained below. Each of the rim portions 20 is crenellated on its free edge, so as to define a series of lugs 24 which are capable of being bent over during the assembly of the header plate with an associated header wall (not shown).

A set of oblong holes 26, identical to each other, is formed through the spine portion 12 of the header plate 10. Three of these holes 26 can be seen in FIG. 1. Each hole 26 has an axis of symmetry XX' extending along its length and at right angles to the rims 14 of the header plate 10. Each hole 26 is defined by two substantially identical oval sections which intersect in a neck 30. In this example, the two sections 28 of each hole 26 are generally elliptical, with their respective major axes being aligned in the direction of the axis XX'. The respective centres of the two elliptical sections 28 define between them a transverse pitch P. In addition, the distance between two adjacent holes 26 is defined by a longitudinal pitch E in the direction at right angles to the transverse pitch P.

Each of the holes 26 is surrounded by a collar portion 32, the contour of which corresponds to that of the two sections 28 of the hole, including the neck 30. Each collar portion 32 projects from the spine portion 12 on the side opposite to the lugs 24. As will be seen later in this description, each hole 26 is arranged to receive the respective end portions of two tubes which are part of two adjacent sets of tubes in a bundle consisting of two sets of tubes of the heat exchanger. Within either one of these sets, the tubes are separated from each other by a pitch equal to the longitudinal pitch E (FIG. 1).

Figure 3:
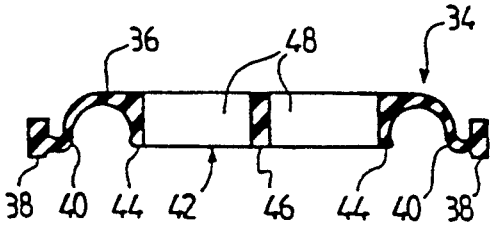
FIG. 3 is a view in cross section of a sealing gasket for the header plate of FIGS. 1 and 2.

Reference is now made to FIG. 3, which shows a sealing gasket 34 which is adapted to be applied on the header plate 10. The gasket 34 is made in a compressible elastomeric material, and has a spine portion 36 of generally rectangular shape corresponding to that of the spine portion 12 of the header plate 10. The spine portion 36 of the gasket is bounded by two longitudinal beads 38 which correspond to the two long sides of the rectangle, together with two lateral beads (not shown) which correspond to the two short sides of the rectangle. The beads 38 are joined to the spine portion 36 of the gasket through an integral web 40. In this way, a bead is obtained which extends over the whole periphery of the gasket, and which is suitable for introduction into the groove 22 of the header plate.

The gasket spine portion 36 includes compressible collar portions 42, each of which has a shape which is adapted to that of a corresponding one of the holes 26 in the header plate, so that it can be introduced into the latter when the spine portion 36 of the gasket 34 is applied against the spine portion 12 of the header plate 10. Thus each collar portion 42 of the gasket has the general shape of a figure-of-eight, comprising two oval, annular portions 44 joined together through an integral bridge 46. Thus, when a compressible collar portion 42 is introduced into a corresponding collar portion 32 of the header plate 10, the two annular portions 44 of the collar portion 42 engage respectively in the two corresponding sections 28 of the hole 26, with the integral bridge 42 being located in the neck 30 of the latter. The gasket spine portion 36 defines two orifices within each compressible collar portion 42. Each of these orifices is adapted to receive the end portion of the corresponding tube of the bundle.

Figure 4:
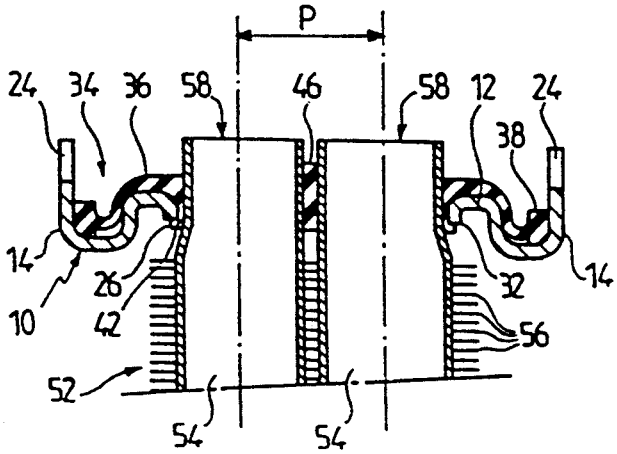
FIG. 4 is a view in transverse cross section through part of a heat exchanger comprising a bundle of tubes assembled on the header plate of FIGS. 1 and 2, with the sealing gasket of FIG. 3 interposed.

FIG. 4 shows one pair of these tubes, associated with one of the holes 26 in the header plate. In FIG. 4, the tube bundle, indicated generally at 52, comprises two sets of tubes 54 of non-circular cross section, which extend through a multiplicity of parallel fins 56. The tubes 54 are separated from each other, as mentioned above, by a longitudinal pitch distance E within the same set of tubes, and by a transverse pitch distance p as between one set of tubes and the other. The tubes 54 have respective end portions 58 of non-circular cross section, which are spaced apart by the same longitudinal pitch E and transverse pitch P as the tubes.

A heat exchanger comprising a header plate, gasket, tubes and fins as described up to this point is of the kind disclosed in the above mentioned French patent specification.

Figure 5:
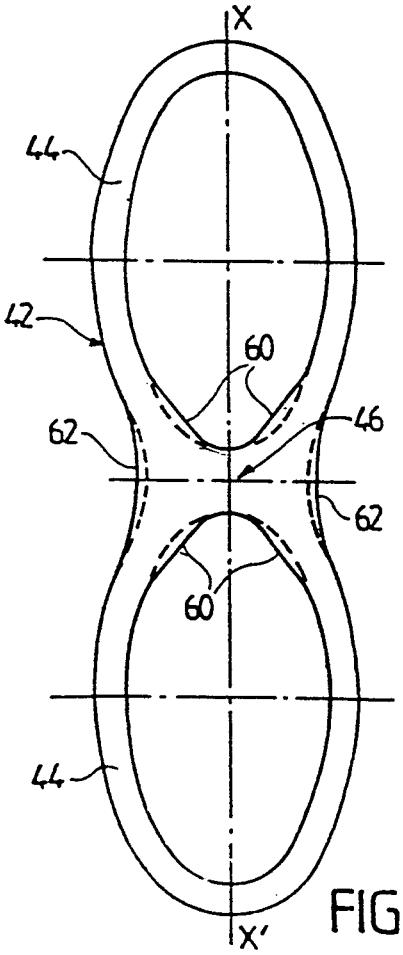
FIG. 5 is an end view on a larger scale, showing a collar portion of the sealing gasket of FIGS. 3 and 4, and in particular showing the thickened zones of its intersection region, which are shown in full lines before being compressed and in broken lines after being compressed.

Reference is now made to FIG. 5. In this Figure, the intersection region or bridge of the collar portion 42 comprises, first of all, a pair of thickened zones 60 disposed on the inner edge of each of the two annular portions 44 of the collar portion 42. In the present case, the annular portions 44 are arranged so that each one can fit around one tube end portion 58, having, as already indicated, a cross section of generally oval or elliptical shape defining a major axis XX'. The thickened zones 60 of each pair are arranged symmetrically about this major axis XX', at the end of the oval or elliptical cross section at which the intersection region 46 is situated.

Before the gasket is compressed, the thickened zones 60 are delimited by a straight edge which constitutes a chord intersecting the oval or elliptical cross section which will later be occupied by a tube end portion 58. After the latter has been fitted in place, the thickened zone is compressed, and its previously straight edge is then curved so as to lie snugly against the oval or elliptical shape of the tube end portions 58 as shown in broken lines in FIG. 5.

As is also shown in FIG. 5, the intersection region 46 also includes two further thickened zones 62, disposed on the outside of the collar portion and arranged to be compressed by the edge of the hole at the neck 30. The thickened zones 62 consequently limit the intersection region 46 in a direction at right angles to the major axis XX'. Each of the external thickened zones 62 joins the outside edges of the two adjacent annular portions 44. Before the gasket is compressed, its thickened zones 62 have an inwardly curved shape as shown in full lines in FIG. 5. However, after the gasket has been compressed, the two thickened zones 62 are compressed respectively between the two opposed regions of the neck 30 of the hole 26 (FIG. 1). The two thickened zones 62 thus fit snugly against the profile of the two opposed sides of the neck 30, as shown in broken lines in FIG. 5. As a result, the zones 62 are forced towards each other, which also applies a compressive force to the gasket.

Thus, the intersection region 46 is not only compressed in the direction of the major axis XX', but also in a direction at right angles to this axis. In this way, the four thickened zones 60 and 62 provide compensation for the lack of compression in the type of gasket described in the French patent specification mentioned above.

It should be noted that the amount of compression between the collar portion and the tube end portion is substantially constant, not only in the annular portions 44, but also in the intersection region 46.

The invention is also applicable to heat exchangers having tube end portions of different cross sections. It is also applicable to heat exchangers which have more than two sets of tubes, in which each of the collar portions of the gasket then has more than two annular portions and at least two intersection regions.

What is claimed is:

1. A heat exchanger comprising: a plurality of sets of parallel tubes constituting a tube bundle, with each tube having an end portion; a header plate formed with a plurality of holes, each hole defining an edge with the end portion of each of a plurality of adjacent said tubes of different sets being received in each hole; and a compressible sealing gasket having a plurality of collar portions, with each collar portion being placed in a respective said hole in the header plate, each collar portion comprising annular portions surrounding respective said end portions of tubes received in the hole, wherein each collar portion defines an intersection region joining the annular portions of the collar portion the gasket having thickened zones relative to the size of the hole at each said intersection region, adapted to be compressed between the edge of the associated said hole and the tube end portions received in said associated hole.

2. A heat exchanger according to claim 1, wherein each said collar portion has internal thickened portions at its intersection region, such that these thickened portions are compressible by the tube end portions received in the respective annular portions of the collar portion.

3. A heat exchanger according to claim 2, wherein said intersection region of each collar portion defines a pair of said thickened zones disposed inside each of the annular portions of the collar portion.

4. A heat exchanger according to claim 3, wherein each said tube end portion has a generally oval or elliptical cross section defining a major axis, each collar portion of the gasket being adapted to match the tube end portions, the thickened zones of each said pair being disposed symmetrically on either side of said major axis.

5. A heat exchanger according to claim 1, wherein the intersection region of each collar portion has said thickened zones disposed on an outside portion of the collar portion and adapted to be compressed by the edge of the associated hole in the header plate.

6. A heat exchanger according to claim 5, wherein each said hole in the header plate has a pair of opposed regions defining a neck between them, the gasket having on each said collar portion a pair of said thickened zones on the outside portion of said collar portion, adapted to be compressed between the opposed regions defining said neck.

7. A heat exchanger according to claim 1, wherein the gasket has said thickened zones disposed on an inside portion of each said collar portion at the intersection region of said collar portion, together with further said thickened zones disposed on an outside portion of the collar portion.

8. A heat exchanger according to claim 1, wherein said thickened zones are so arranged that the amount of compression between each collar portion of the gasket and the associated tube end portion is substantially constant.

* * * * *

UNITED STATES PATENT AND TRADEMARK OFFICE

CERTIFICATE OF CORRECTION

PATENT NO. : 5,299,636

DATED : April 5, 1994

INVENTOR(S) : Michel Potier

It is certified that error appears in the above-identified patent and that said Letters Patent is hereby corrected as shown below:

In claim 1, column 5, line 40, please insert -- , -- after the word "portion".

Signed and Sealed this

Twentieth Day of December, 1994

*Attest:*

Bruce Lehman

BRUCE LEHMAN

*Attesting Officer*

*Commissioner of Patents and Trademarks*